US005959272A

United States Patent [19]

Marchitto

[11] Patent Number: 5,959,272

[45] Date of Patent: Sep. 28, 1999

[54] FAIL SAFE ROLLER SWITCH

[75] Inventor: Nickolas E. Marchitto, Avon, Conn.

[73] Assignee: Otis Elevator Company, Farmington, Conn.

[21] Appl. No.: 08/990,244

[22] Filed: Dec. 23, 1997

[51] Int. Cl.[6] ..... H01H 3/16

[52] U.S. Cl. ..... 200/61.42; 200/61.17; 200/61.18; 200/61.83; 187/282

[58] Field of Search ..... 200/562, 558, 200/573, 574, 61.83, 332, 335, 61.17, 61.18, 61.42; 187/282, 283, 394

[56] References Cited

U.S. PATENT DOCUMENTS 4,295,017 10/1981 Kashima et al. ..... 200/47
5,276,299 1/1994 Marsh ..... 200/570

*Primary Examiner*—Michael L. Gellner
*Assistant Examiner*—Lee S. Lum

[57] ABSTRACT

A switch (8) having an arm (12) and a roller (16) includes a biasing force generating means (140, 150, 160) for operating the switch in the event the roller (16) is detached.

4 Claims, 2 Drawing Sheets

FAIL SAFE ROLLER SWITCH

TECHNICAL FIELD

This invention relates to a mechanically operated electrical switch.

BACKGROUND OF THE INVENTION

Electrical switches actuated by a swing arm having a roller at an end of the arm are well known in the art. Such roller switches may be operated by contact with a moving cam surface and are frequently used as position limit switches in various mechanical applications. In one such application, a passenger elevator, a roller switch is attached to the moving elevator car with the actuating cam surfaces fixed at the upper and lower ends of the elevator hoistway, whereby the roller switch is actuated as the elevator approaches the limits of travel defined by the hoistway. Alternatively, the locations of the roller switch and the actuating cam may be interchanged.

As such limit switches may be used to sense the presence of the elevator car in an area proximate to the ultimate mechanical limit of travel, it is critical that such switches, if they are not in proper operating condition, provide a signal or other failure mode whereby the system controls may detect the switch failure. In particular for roller switches, one failure mode would occur if the roller bearing or other roller attachment means were to detach from the switch arm. In this situation, the roller would fall or otherwise be lost from the roller switch, which would then, in the prior art, fail to contact the cam surface and thus fail to sense the presence of the elevator at or beyond its extreme motion limits.

What is needed is a roller switch which will signal the elevator control system in the event of a loss or detachment of the roller from the switch arm.

DISCLOSURE OF THE INVENTION

It is an object of the present invention to provide a cam-operated roller switch having fail safe operation in the event the switch roller becomes detached or otherwise lost.

According to the present invention, a roller switch having a vertically moving switch arm, terminating in a roller for contacting a cam surface or the like, is provided with a means for biasing the switch arm. The biasing means applies a limited force to the switch arm, attempting to drive the switch from a first normal, or unactuated, position into a second, actuated, position. The force is not sufficient to move a switch arm and roller in combination, but is sufficient to move the switch arm in the event the roller becomes detached from the switch arm due to bearing failure or otherwise.

The switch, according to the present invention, operates as a typical cam-operated roller switch under normal conditions. In the event the roller is lost or detached, the switch arm is driven into an operated position by the biasing means, thus alerting the system controller that the switch has ceased to operate properly. When configured as a position limit switch, or the like, the switch according to the present invention is particularly effective in detecting a failure of a roller or the roller attachment means, thereby preventing injury to passengers and/or damage to the elevator or other associated equipment.

The foregoing and other objects, features and advantages of the present invention will become more apparent in light of the following detailed description of the exemplary embodiments thereof, as illustrated in the accompanying drawings.

BEST MODE FOR CARRYING OUT THE INVENTION

Figure 1:
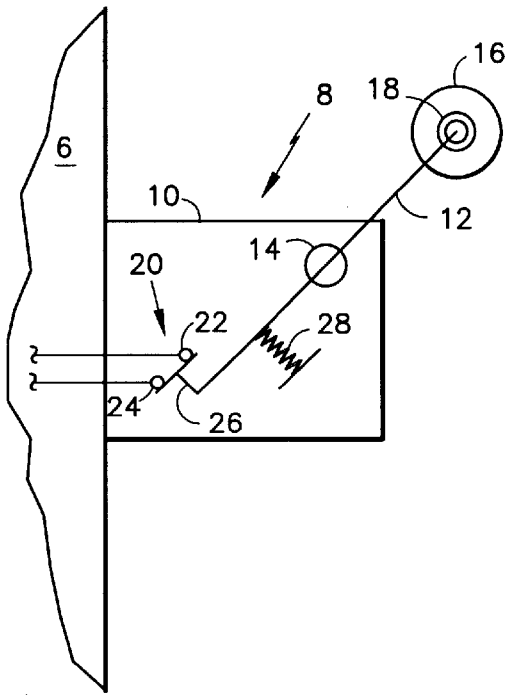
FIG.1 prior art
FIGS. 1 and 2 show a cam-operated roller switch according to the prior art.

FIG. 1 shows a schematic view of a prior art switch comprising a body portion 10 having a pivoted switch arm 12 which rotates in a vertical plane about a pivot axis 14. At one end of the switch arm 12 is a roller 16, which is rotatably secured to the end of the arm 12 by a bearing 18. At the opposite end of the switch arm 12 is the contact assembly 20, shown in FIG. 1 as a normally closed configuration. For the sake of illustration, contact assembly 20 is shown as a pair of exposed contacts 22, 24, which are normally connected electrically by a contact plate 26 secured to the end of the switch arm 12 opposite the roller 16. A restoring spring 28 is also shown.

Figure 2:
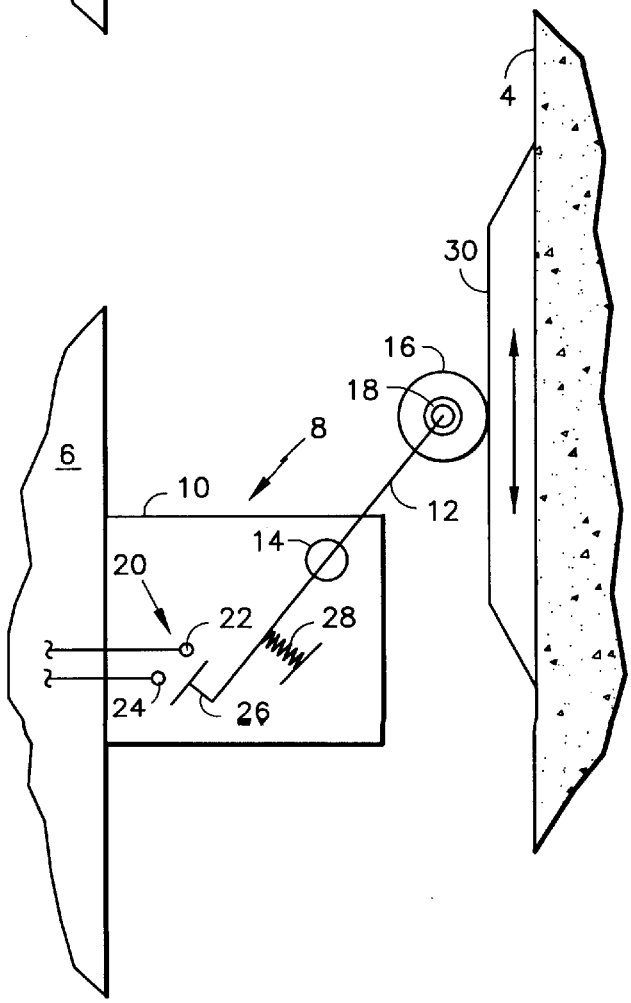
FIG.2 prior art

FIG. 2 shows the prior art roller switch in its second, or actuated, position whereby roller 16 has contacted a cam surface 30, causing switch arm 12 to rotate about pivot 14 in a counterclockwise direction. As shown in FIG. 2, the rotation of the switch arm 12 has caused the contact plate 26 to separate from contacts 22, 24, thereby breaking the electrical connection therebetween.

Such prior art switches are used frequently in mechanical applications, such as an elevator running in a hoistway in which it is highly desirable to detect the approach or presence of the elevator car at various locations throughout the hoistway. For the switch 8, as shown in FIGS. 1 and 2, the switch housing 10 may be mounted on the elevator car 6 and disposed so as to contact a cam surface 30 precisely located on the hoistway wall 4. As the elevator car traverses the hoistway, the switch 8, and in particular the roller 16 thereof, contacts the cam surface or surfaces 30 thereby opening the switch assembly 20 and providing a signal (or lack thereof) to the elevator controller (not shown). It will be appreciated by those skilled in the art that the switch assembly 20, in the prior art as well as in the invention described below, could just as easily be arranged so as to provide a normally open switch arrangement, as well as multiple pole and/or multiple throw switching arrangements. The only criteria for use as a position sensing switch is that the roller end of the switch arm 12 contact the cam surface 30 when the elevator car has entered a location of interest to the elevator system controls.

Figure 3:
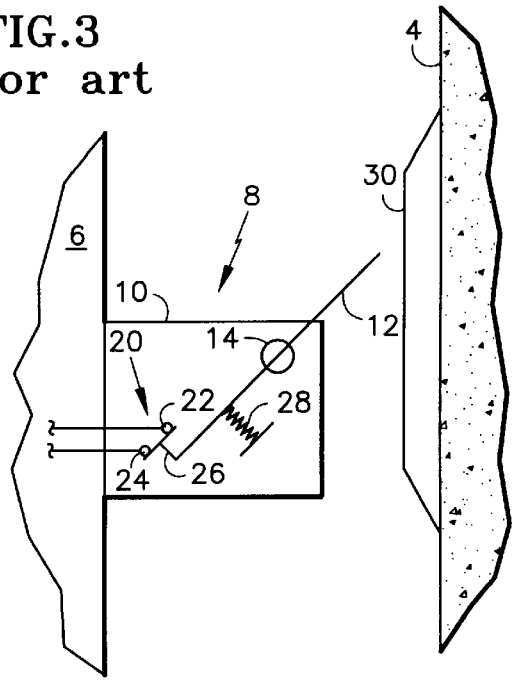
FIG.3 prior art
FIG. 3 shows a prior art roller switch wherein the roller has become detached.

One drawback, as recited above, is that the roller end of the switch arm 12 may experience a failure in the form of a bearing failure, etc. which would result in the loss of the roller 16. Such loss is illustrated in FIG. 3 wherein it is apparent that the absence of the roller 16 (not shown in FIG. 3) has resulted in the switch arm 12 failing to contact the cam surface 30 and thereby failing to actuate the switch assembly 20. This failure results in the inoperability of the switch 8 when in proximity to the cam surface 30. For a final position limit switch, such failure may result in a failure of the elevator to stop, leading to damage of the elevator or other associated equipment.

With particular regard to the prior art switch illustrated in FIGS. 1–3, it is readily apparent that the loss of the roller 16 will not result in any change in the status of the output of the switch 8, but rather the switch assembly 20 remains in its normal (contact) configuration. It is only by testing or inspection that the loss of the roller 16 is discovered.

In order to avoid the prior art problems of the prior art switch as illustrated in FIGS. 1–3, the switch according to the present invention provides a biasing means which attempts to rotate the switch arm 12 from the normal, unactuated position into its actuated position, thereby alerting the control system that the switch has become inoperable.

Figure 4:
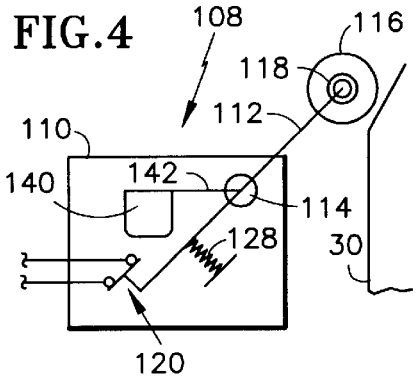
FIG. 4 shows a roller switch according to the present invention.

Referring now to FIG. 4, a switch according to the present invention is shown and described.

In similarity with the prior art switch 8, the switch 108 according to the present invention includes a housing 110, a switch arm 112, and an end roller 116 rotating about a bearing 118. Switch arm 112 pivots in a vertical plane about a pivot axis or shaft 114 secured to the switch housing 110. An optional restoring spring 128 is also shown. A contact assembly 120 functions identically with the assembly 20 of the prior art switch 8.

The switch 108 according to the present invention includes a biasing means for applying a counterclockwise biasing moment to the switch arm 12 in the form of a weight 140 secured at the end of a lever arm 142 which is in turn secured to the switch arm 112. Weight 140 is sized so as to be insufficient to rotate the switch arm 112 as long as the roller 116 remains rotatably secured to the end of the switch arm 112. It will further be appreciated by those skilled in the art that the roller switch 108 operates virtually identically to the prior art switch 8, in that contact of the roller 116 with a cam surface (not shown in FIG. 4) will displace the roller 116 laterally, thereby causing the switch arm 112 to rotate counterclockwise about the pivot 114, opening the contact means 120. Thus, the switch according to the present invention, barring failure of the roller bearing, etc., operates as a normal cam actuated roller switch known in the prior art.

Figure 5:
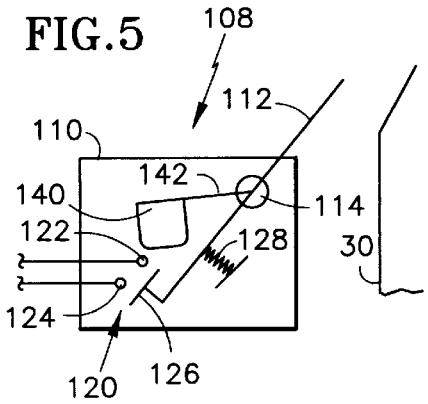
FIG. 5 shows a roller switch according to the present invention, wherein the roller has become detached.

In the event the roller 116 is separated from the switch arm 112, the biasing means provided in the switch according to the present invention results in a fail-safe condition within the switch 118 as is illustrated in FIG. 5.

FIG. 5 shows the roller missing from the switch arm 112, whereby the weight 140 and lever arm 142 exert a sufficient counterclockwise moment on the switch arm 112 about the pivot 114 so as to cause a switch arm 112 to rotate counterclockwise. This counterclockwise rotation results in separation of the contact plate 126 from the contacts 122, 124, thus placing the switch 108 in an activated configuration regardless of its location relative to the actuating cam surface (not shown).

In the event of switch 108 finding use as a position limit switch, the loss of the roller 116 is immediately sensed by the relevant control system (not shown) as an excursion of the elevator at or beyond its extreme motion limits. The switch 108 thus fails safely when the roller 116 is lost, thereby providing the opportunity to correct the problem immediately.

Figure 6:
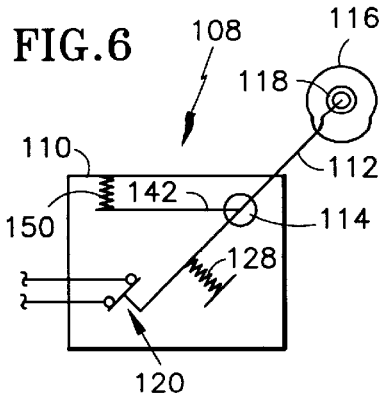
FIGS. 6 and 7 show alternative embodiments of the roller switch according to the present invention.
Figure 7:
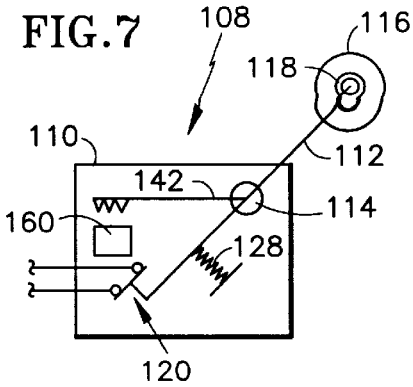

FIGS. 6 and 7 show alternative biasing means such as a spring 150 urging lever arm 142 downward as shown in FIG. 6, thereby applying counterclockwise torque to the pivoted switch arm 112 in the proper range. Also, FIG. 7 shows the lever arm 142 being pulled, at its end, by a magnet 160, which may be electrical or permanent.

In each case, the present invention provides a means for biasing the switch arm 112 which is insufficient to overcome the opposite bias induced by the presence and weight of the roller 116, but which is also sufficient to positively rotate the switch arm 112 in the event the roller 116 becomes detached from the end of the switch arm 112.

Thus, any number of biasing means, including torsional springs, elastic materials, leaf springs, or other urging means may be provided equivalently. It is also apparent that the switch 108, shown schematically herein for illustrative purposes, could readily have any number of configurations, connections, or operating modes, provided that each resulted in a switch arm and roller assembly wherein a biasing means may provide sufficient force to actuate the underlying switch or switches in the event the roller becomes detached from the end of the switch arm.

Although the invention has been described and illustrated with respect to exemplary embodiments thereof, it should be understood by those skilled in the art that the foregoing, and various other changes, omissions and additions may be made without departing from the spirit and scope of the present invention.

What is claimed is:

1. In a mechanically operated electrical switch having a pivoted switch arm moving in a vertical plane and terminating at one end in a roller for contacting a cam surface, said switch operable between a first position when said roller is not in contact with said cam surface and a second position when said roller is in contact with said cam surface, the improvement comprising means for biasing said switch arm toward said second position, said biasing means sized so as to independently move said arm into said second position upon the loss of said roller from said arm.

2. A switch as recited in claim 1, wherein said biasing means comprises a spring.

3. A switch as recited in claim 2, wherein said biasing means comprises a weight.

4. The switch as recited in claim 1, wherein said biasing means comprises a magnet.

* * * * *